United States Patent [19]

Johnson

[11] 4,265,507

[45] May 5, 1981

[54] ELECTRICAL CONNECTOR FOR STRIP CONDUCTORS

[75] Inventor: Donald L. Johnson, Olivenhain, Calif.

[73] Assignee: Teledyne Industries, Inc., Los Angeles, Calif.

[21] Appl. No.: 64,002

[22] Filed: Aug. 6, 1979

[51] Int. Cl.[3] ..... H01R 13/36

[52] U.S. Cl. ..... 339/176 MF

[58] Field of Search ..... 339/17 F, 176 MF

[56] References Cited

U.S. PATENT DOCUMENTS

| | | | |
|---|---|---|---|
| 3,633,152 | 1/1972 | Podmore | 339/176 MF |
| 3,763,307 | 10/1973 | Wolf | 339/176 MF |
| 3,848,946 | 11/1974 | Halley et al. | 339/17 F |

FOREIGN PATENT DOCUMENTS

| | | | |
|---|---|---|---|
| 2323914 | 11/1973 | Fed. Rep. of Germany | 339/176 MF |

*Primary Examiner*—Joseph H. McGlynn

[57] ABSTRACT

An electrical connector for effecting connection to a multiple strip flexible conductor cable is disclosed which includes a body member having a plurality of resilient electrical terminals supported in parallel by the body member and extending from a first surface thereof. The connector also includes a shell having a top adapted to fit over the first surface of the body member and depress a strip cable into positive contact with the terminals, thereby depressing the ends of the terminals against the body member.

4 Claims, 7 Drawing Figures

ELECTRICAL CONNECTOR FOR STRIP CONDUCTORS

BACKGROUND OF THE INVENTION

The background of the invention will be discussed in two parts:

FIELD OF THE INVENTION

This invention relates to electrical connectors and more particularly to an electrical connector for making contact to a strip conductor carrying a number of individual conductors.

DESCRIPTION OF THE PRIOR ART

Many uses have been found in the prior art for flexible flat conductor cables which carry a multiplicity of individual conductors aligned in parallel. Such cables often furnish the connections to a printed circuit board or the like. Various means have been designed for connecting such flexible conductor cables to particular electrical circuits. Among these are connectors which require that substantial force be exerted on the flat conductor cable when it is inserted into the connector. Since such forces tend to generate electrical faults it is desirable that such insertion forces be reduced or eliminated.

All such connectors have as a design criteria that each of the conductors in the cable be positively conductively connected by the connector both initially and throughout the operation of the circuits. Various prior art connectors have operated to provide effective conductive connection to such circuits in particular environmental situations. However, many connectors of the prior art do not continue to provide positive connection to all conductors of a flexible strip cable throughout the operation of the circuits; and, consequently, intermittant operation or failure of the circuits may occur.

Circuits utilizing flexible strip cables are often subject to substantial environmental changes which cause mechanical forces to be applied that tend to distort the connectors. For example, changes in temperature, altitude, humidity, and the like may all affect the structure of a connector and the forces applied thereto and tend to distort and disturb the electrical connections made by such connector. One method of compensating for such distortion has been to utilize connectors having relatively substantial cross sections whereby distortion of the dimensions of the connector may be essentially eliminated. Although this may be successful in some cases, the space required to provide such cross sectional dimensions for a connector may be insufficient. This is especially true with physically wide flexible strip conductor cables.

Many connectors for flexible strip cable are subject to mechanical shock from tension on the cable due to vibration or the like. The connector in such a situation must maintain a positive connection to each of the individual conductors of the strip cable. Many prior art connectors do not provide such positive connection in the face of mechanical stress.

It is an object of the present invention to provide a new and improved zero insertion force connector for mass connection of the conductors in a multiple strip conductor cable to printed circuit boards or the like.

it is another object of the present invention to provide a connector for multiple strip conductor cable which will maintain positive connection to each of the conductors of the cable in the face of substantial environmental variations.

It is a further object of the invention to provide a new and improved connector for multiple strip conductor cable which will maintain positive connection to each of the conductors of the cable in the face of substantial physical shocks.

It is yet another object of this invention to provide a connector for multiple strip conductor cable which exhibits little tendency to distort in the face of environmental changes and shocks yet presents a minimal profile.

SUMMARY OF THE INVENTION

The foregoing and other objects of the invention are accomplished by a two-piece connector which includes a first dielectric body member of essentially block form having an upper surface and a series of parallel conductive terminals mounted in the block and projecting at essentially right angles to the upper surface. The terminals are bent at just less than a right angle where they project from the block and at a very shallow angle approximately half way between the point at which they project from the block and their ends. Thus, the terminals lie essentially parallel to the upper surface of the block and have a free end.

The two longer sides of the block each has mounted thereon a projecting guide surface. The lower surface of the block has downwardly extending projections which are adapted to engage a connector cover.

The second portion of the connector is essential a dielectric box with the lower surface of the block removed to provide a shell or cover. The sides of the box on the interior are provided with guide surfaces adapted to cooperate with the guide surfaces on the block. When a strip conductor is placed over the terminals on the upper surface of the block and the cover is slid over the upper surface of the block, it depresses the terminals against the conductor strip. The guide surfaces on the block and on the cover cause the top of the cover to depress the terminals and the terminals to form positive springs to hold the strip conductor in position. The connector provides a substantial force to maintain the strip conductor in position. First pressure by the shell on the terminal induces a spring force where the terminals exit the block; the same pressure by the shell also forces the free ends of the terminals against the surface of the block to increase the force at the contact point. Each of the terminals may have a cone point in its upper surface to provide for more positive contact with the conductors of the strip cable.

The shell covers the front surface of the block and causes the strip cable conductor to lie tightly against the block. The bottom of the shell which is cut away has a partial lip and a pair of projections which, when the shell has been forced over the block, lock into place on the notches extending from the block. This lock is held fast by the spring action of the terminals pressing against the top surface of the shell. Consequently, the shell remains solidly in place and holds the strip cable conductor in place even though substantial shocks may be applied to the cable conductor.

The box-like shape of the shell provides substantial strength to protect against warpage over the broad surface along which contact is made with the strip cable conductor. Consequently, the strip cable conductor is maintained in place even though substantial changes take place in the atmospheric or mechanical conditions which would normally warp a connector of such dimensions.

Other objects, features, and advantages of the invention will become apparent from a reading of the specification when taken in conjunction with the drawings in which like reference numerals refer to like elemrnts in the several views.

DESCRIPTION OF THE PREFERRED EMBODIMENT

Figure 1:
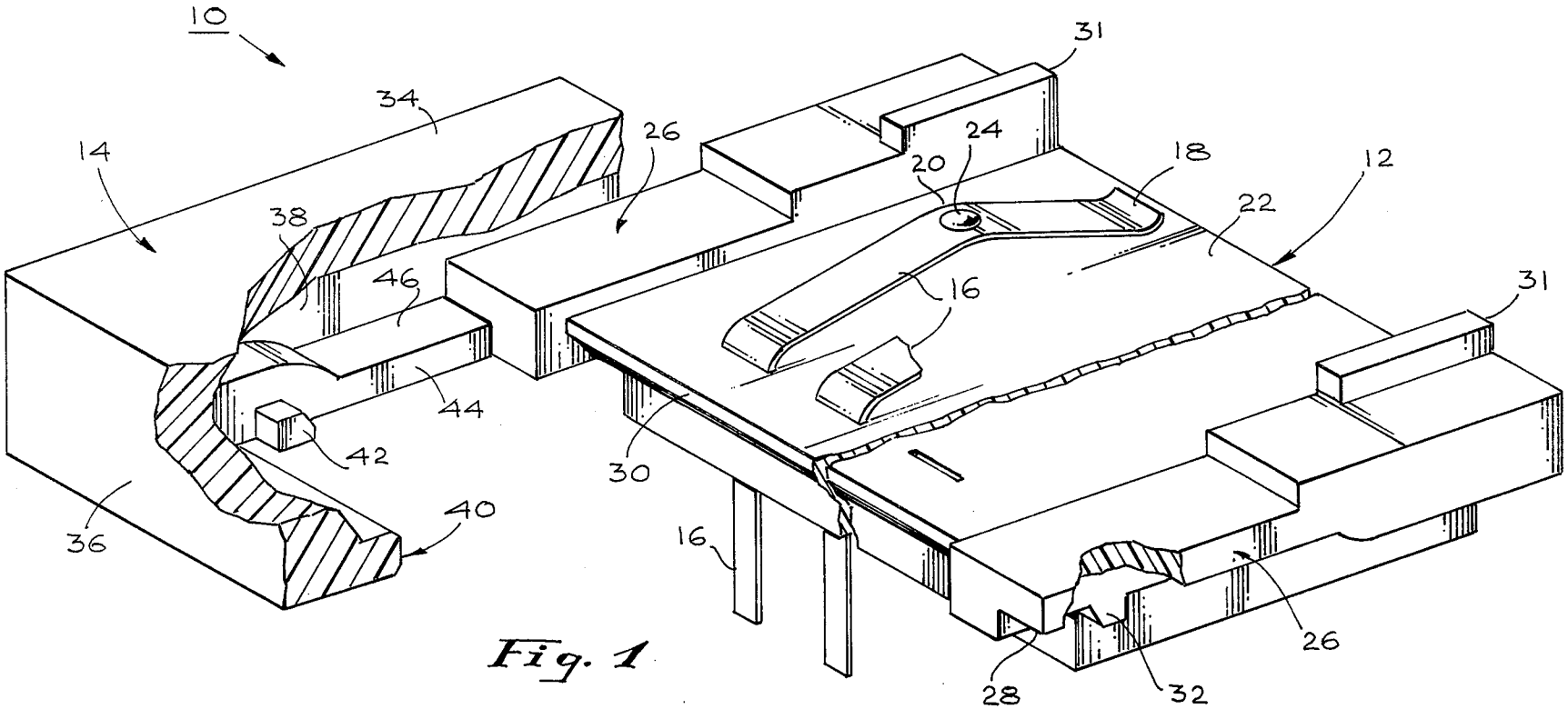
FIG. 1 is a partial cut away perspective view showing two parts of a connector constructed in accordance with the invention.
Figure 2:
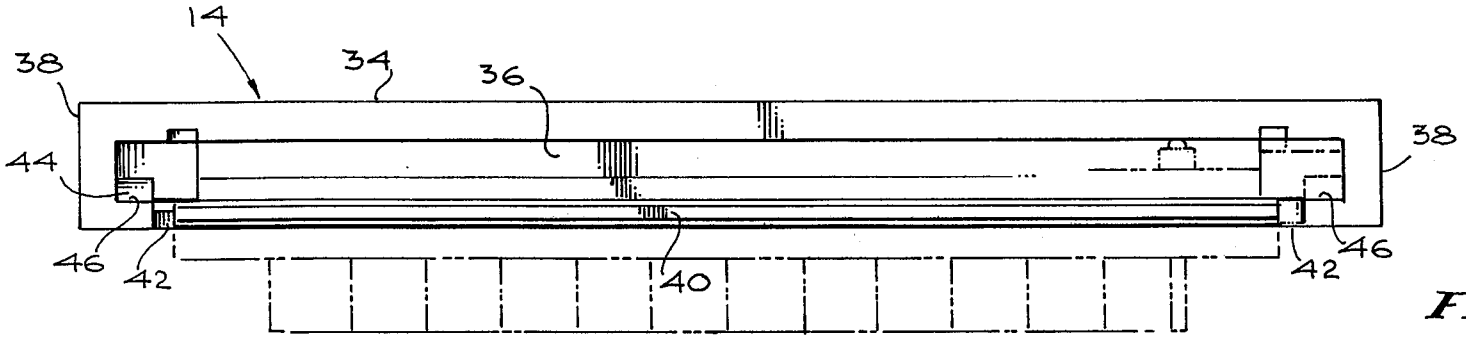
FIG. 2 is an end view of the shell of the connector shown in FIG. 1 also showing in phantom lines in the position of a block portion of the connector.

Referring now to the drawings and more particularly to FIG. 1, there is shown a perspective view of a connector generally designated 10 including a first body member comprising block 12 of a printed circuit board or other circuit to which a multiple strip conductor cable is to be connected. Also shown in an exterior shell or cover 14 of dielectric material which is adapted to fit a multiple strip conductor cable to the block 12. The block 12 mounts a series of resiliant electrical terminals or conductors 16 which are parallel to each other. Each of the conductors 16 corresponds to and makes electrical connection with a respective one of a plurality of conductors in a flexible flat conductor cable (not shown in FIG. 1).

The block 12 may be molded from a dielectric material such as a thermal setting plastic or a thermoplastic material wellknown in the art. The conductors 16 may be formed of a metal such as a copper alloy and be of various shapes although in the embodiment described they terminate in essentially flat conductive ribbons. The conductors 16 are bent at just less than a right angle where they exit from the upper surface of the block 12. The conductors 16 angle slightly upward from the point at which they project from the block 12, have a slight bend at points 20 near the middle of their projecting length, and angle slightly downwardly so that their free ends 18 lie (in the unstressed positions) just above an upper surface 22 of the block 12. Each of the conductors 16 may have mounted thereon a contact point 24 approximately at the bend at 20. This contact point 24 is relatively sharp and assists in making conductive contact to the conductors of the multiple strip conductor cable.

The block 12 has on opposite sides of upper surface 22 a pair of sides 26 which may be molded as a part of the block 12. Each side 26 has a shaped surface 28 adapted to cooperate with a surface of the shell 14 in assembling the connector 10, as will be explained below. The front edge of the block 12 has a ledge 30 about which a multiple strip conductor cable may be fit. The distance across the upper surface 22 between the inner surfaces of sides 26 is just sufficient to provide for the entry and positioning of a multiple strip conductor cable as will be explained below. A pair of aligning projections 31 extend upwardly from the sides 26. Projecting from the lower surface of the block 12 are depending notches 32 which cooperate with the shell 14 to provide a lock for maintaining the multiple strip conductive cable in position.

As shown in the Figures, the shell 14 is essentially a box having a top 34, and end 36, sides 38 and a lip 40 partially extending in the space where a bottom would normally be positioned. Also extending from the sides 38 of the shell 14 are a pair of projections 42 which are adapted to cooperate with the notches 32 of the block 12 to provide a locking arrangement for the connector 10. The projections 42 are mounted to inwardly extending thickened sections 44 of sides 38; each of sections 44 has an upper surface 46 thereon adapted to cooperate with the surfaces 28 on the block 12.

In use, a cable 48 (shown in FIGS. 3 through 7) is inserted between the lip 40 of the shell 14 and the block 12 and runs upwardly around the ledge 30 of the block 12 and over the upper surface of the conductors 16 where it makes conductive contact, especially at the contact points 24. As will be appreciated from FIG. 7, the projections 42 lock against the notches 32 in such a manner that the shell 14 cannot be withdrawn from the block 12 without depressing the top 34. This locking feature is facilitated by the force applied by the conductors 16. The conductors 16 are urged downwardly at point 24 and thus act as a spring at the point where they bend upon emerging from the upper surface 22 of the block 12. The downward urging at point 24 also forces conductors 16 (at the right end 18 as shown in FIG. 7) against the upper surface 22 of the block 12 to generate another springing force. These forces are substantial and provide contact force to electrical connection and positive locking of the shell 14 in place.

Figure 3:
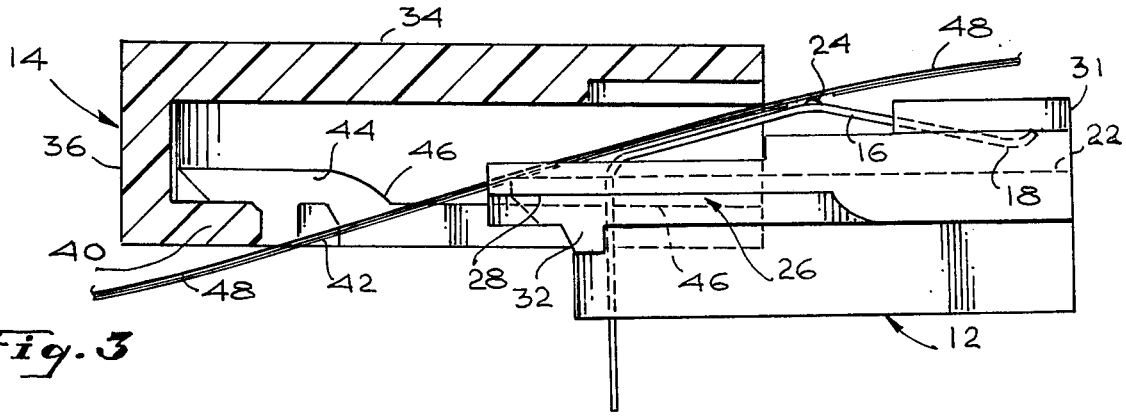
FIGS. 3 through 7 are side cross-sectional views showing five different positions of the connector of FIG. 1 when the connector is being assembled.
Figure 4:
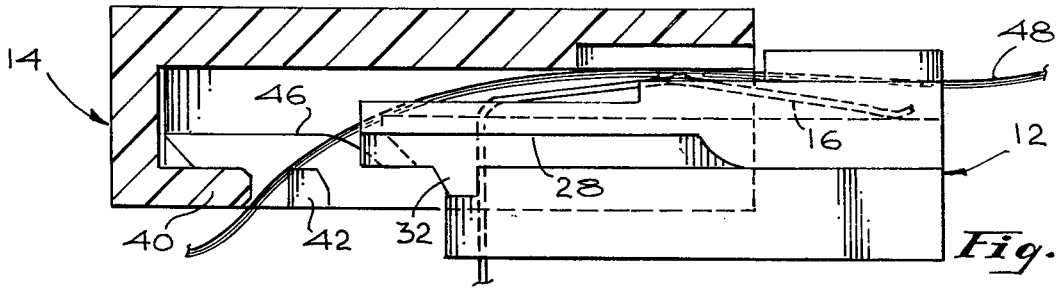
Figure 5:
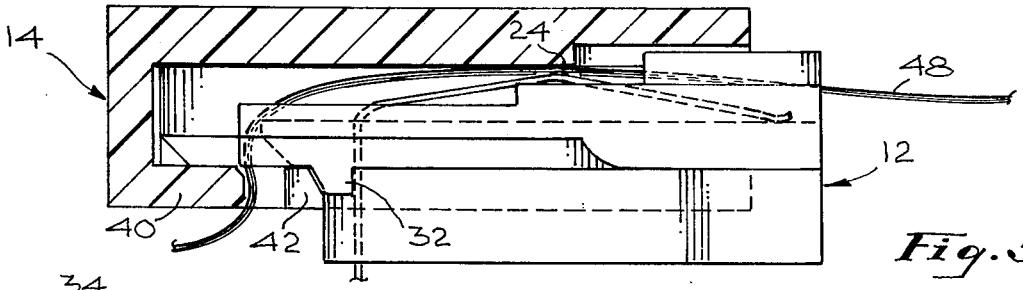
Figure 6:
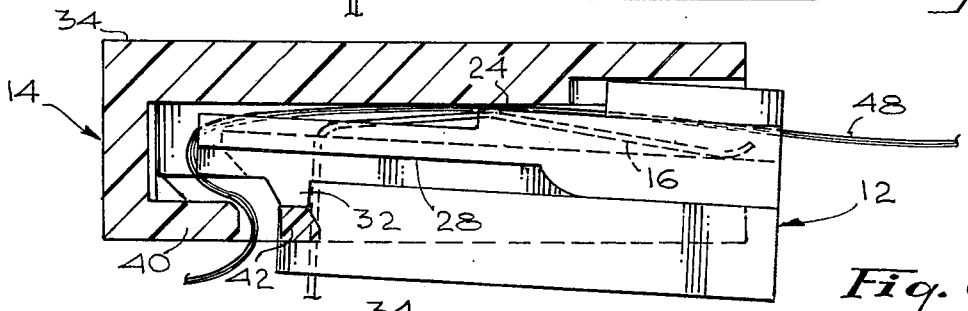
Figure 7:
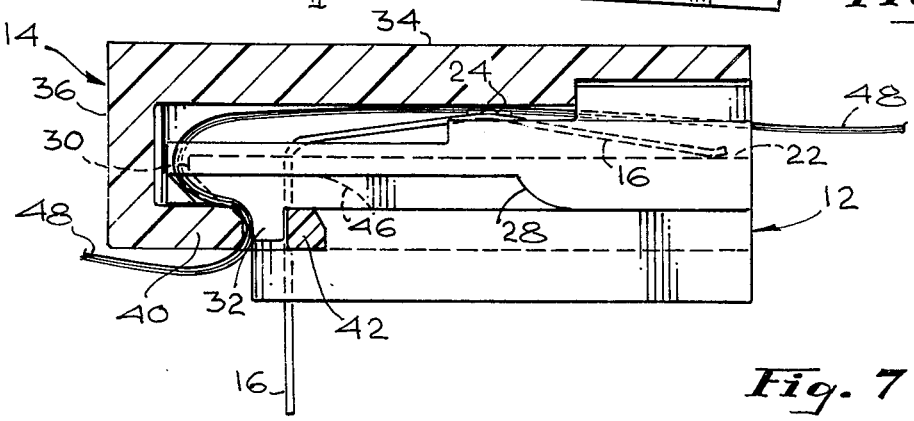

The operation by which the shell 14 is placed over the block 12 in order to secure a cable may be better understood by viewing FIGS. 3 through 7, which are sequential views showing the assembly of the block 12, the shell 14 and the cable 48. In FIG. 3, the shell 14 has a cable 48 inserted there. The cable 48 is laid across the upper surface 22 of the block 12 between the projections 26 and covers the conductors 16. As is shown in FIGS. 4 and 5, the shell 14 and the block 12 are then pushed together so that the surfaces 28 and 46 first touch and then begin to slide along each other, drawing the shell 14 down toward the block 12. The surfaces 28 and 46 may thus be considered to be cam surfaces, and the drawing of the shell 14 down toward the block 12 may be considered to be a cam following action. This compresses conductors 16 against the cable 48 at the contact points 24 and forces the right end 18 of conductors 16 against the upper surface 22 of block 12. As is shown in FIGS. 5 and 6, further sliding of shell 14 along body 12 causes the ramp of notches 32 to engage the ramp of projections 42, causing the notches 32 to ride up onto projections 42, further compressing the conductors 16. As is shown in FIG. 7, shell 14 then seats against block 12 and notches 32 drop behind projections 42, locking the shell 14 in place.

FIG. 7 shows the final position in which the cable 48 is locked and held in place by the force applied by the lip 40 against protruding ledge 30 and by the forces applied by the conductors 16. Each conductor 16 now applies force to the cable 48 at its contact point 24 because of two separate spring forces. The first spring force is caused by the spring at the left side of the upper surface 22 where the conductor 16 projects from the block 12. The second spring force appears at the right side of surface 22 where the end 18 of the conductor 16 is forced downwardly into the upper surface 22 of the block 12 by the top 34 of the shell 14. In this final position, the surfaces 28 and 46 now lie against each other over a substantial distance to position the shell 14 on the block 12 in a stable manner.

It will be appreciated that the connector 10 of the present invention offers significant advantages over the connectors disclosed by the prior art. Because of the multiple springing action of the conductors 16 pressing against the cable 48 at the contact points 24, a substantial force maintains the conductive contact with each of the conductors of the cable 48. Furthermore, because the cable 48 is forced into a substantially S shape by the shell 14 and the block 12, the cable 48 has the conductive connections at the contact points 34 protected from longitudinal strain which may occur at the other end of the cable 48. Strains applied to the lower end of the cable 48 are essentially eliminated by the clamping action between the lip 40 and ledge 30 upon the conductor. Consequently, such strains are unable to affect the conductive contact at points 24. Furthermore, the substantial force applied upwardly by the conductors 16 against the top 34 locks the shell 14 to the block 12 to maintain the cable 48 in position.

A substantial advantage of the present invention is the narrow profile presented by the shell 14 and the block 12 when assembled. Normally, the top 34 of the shell 14 would have to be quite thick in order to apply th compressive force necessary across the entire upper surface 22 of the block 12. This is true because the top 34 must resist bending caused by the large number of conductors 16 which apply force against it. The force is especially high because the two substantial forces at the right and left ends of the conductors 16 are summed and applied against the top 34 as explained above. However, the top 34 of the present invention is quite thin yet maintains its shape without distortion thereby eliminating any failure of contacts at any of the contact points 24.

This is accomplished by constructing the shell 14 of a material (which may be a thermoplastic polyester such as Valox 420 SEO) which has a relatively rigid structure to resist bending and warpage and by designing the shell 14 so that the top 34 is supported by sides 38, the end 36, and the lip 40 in a multiple beam structure mush like an I-beam. The lip 40, interlocking under the protruding ledge 30 of block 12, closes the structural loop started by force of conductors 16 protruding from block 12. For example, when a force is exerted upwardly on the lower surface of the top 34 by conductors 16, the tendency of the top 34 to warp upwardly is resisted by lip 40 being compressed against protruding ledge 30 of block 12. In view of the high ratio of thickness to protruded length of lip 40 and protruding ledge 30 and of the fact that the material of which the shell and block 12 are constructed is relatively proof against such compression at the level at which such forces might be applied, warpage affecting the shape of the shell 14 is eliminated. Consequently, the shell 14 and the block 12 are able to fit into circuitry packages much smaller than might be expected.

While there has been shown and described a preferred embodiment, it is to be understood that various other adaptations and modifications may be made within the spirit and scope of the invention.

What is claimed is:

1. A connector for making electrical connection to a flexible conductor cable comprising:

a body member including a plurality of resilient electrical terminals supported in parallel by the body member and extending from a first surface thereof, each of the terminal members having a free end, and a shell which fits over the first surface of the body member and depresses a cable to which electrical connection is to be made into positive contact with the terminals, thereby depressing the free ends of the terminals against the body member, thereby providing high contact force against the cable, the shell including a top, an end molded to the top at a right angle thereto, a pair of sides molded to the top and end, and a lip parallel to the top molded to the sides and end, with the top depressing the cable into positive contact with the terminals and the lip being positioned on the surface of the body member opposite the first surface thereof, whereby the tendency of the shell to warp from forces exerted on the top by the resilient terminals is resisted by the lip being compressed against the opposite surface of the body member.

2. An electrical connector as claimed in claim 1 which further comprises means for locking the shell to the body member, the locking means comprising a pair of notches projecting from opposite surfaces of the body member and a pair of projections in opposing surfaces of the shell adapted to be forced into locking relationship with the notches by spring action of the electrical terminals.

3. An electrical connector as claimed in claim 1 further comprising a first pair of surfaces on respective opposite sides of the body member, and a second pair of surfaces on respective opposite sides of the shell adapted to mate with the first pair of surfaces to facilitate the positioning of the body member and the shell.

4. An electrical connector as claimed in claim 3 in which the first and second pairs of surfaces are cam surfaces which draw the shell downward towards the first surface of the body member when the shell is slid onto the body member.

* * * * *